US011241607B2

(12) United States Patent
Kim

(10) Patent No.: US 11,241,607 B2
(45) Date of Patent: Feb. 8, 2022

(54) SWING PRACTICE DEVICE FOR EMITTING LIGHT AT IMPACT THROUGH SELF-GENERATION

(71) Applicant: Youngdeuk Kim, Gyeonggi-do (KR)

(72) Inventor: Youngdeuk Kim, Gyeonggi-do (KR)

(73) Assignee: Youngdeuk Kim, Gyeonggi-do (KR)

( * ) Notice: Subject to any disclaimer, the term of this patent is extended or adjusted under 35 U.S.C. 154(b) by 0 days.

(21) Appl. No.: 17/264,186

(22) PCT Filed: Jun. 21, 2019

(86) PCT No.: PCT/KR2019/007493
§ 371 (c)(1),
(2) Date: Jan. 28, 2021

(87) PCT Pub. No.: WO2020/027435
PCT Pub. Date: Feb. 6, 2020

(65) Prior Publication Data

US 2021/0146217 A1 May 20, 2021

(30) Foreign Application Priority Data

Jul. 30, 2018 (KR) ..... 10-2018-0088271

(51) Int. Cl.
*A63B 69/36* (2006.01)

(52) U.S. Cl.
CPC ..... *A63B 69/3632* (2013.01); *A63B 2209/08* (2013.01); *A63B 2220/36* (2013.01); *A63B 2225/74* (2020.08)

(58) Field of Classification Search
CPC ..... A63B 69/3632; A63B 2225/74; A63B 2209/08; A63B 2220/36; A63B 60/04;
(Continued)

(56) References Cited

U.S. PATENT DOCUMENTS 6,254,493 B1 * 7/2001 Wurster ..... A63B 24/0003 473/220
6,770,002 B2 * 8/2004 Aigotti ..... A63B 60/00 473/457
(Continued)

FOREIGN PATENT DOCUMENTS

JP 2016-112395 A 6/2016
KR 10-2003-0010966 A 2/2003
(Continued)

*Primary Examiner* — Nini F Legesse
(74) *Attorney, Agent, or Firm* — IP & T Group LLP

(57) ABSTRACT

A swing practice device for emitting light at impact through self-generation enables an impact moment to be checked with the naked eyes without needing a battery by emitting light at an impact time point through self-generation during swinging by using a golf club, a baseball bat, and the like. The swing practice device includes a power generation magnet provided to a shaft so as to slide in the longitudinal direction of the shaft during swinging; a power generation coil provided on the circumference of a section in which the power generation magnet moves; a light-emitting lamp connected to the power generation coil so as to be turned on by the movement of the power generation magnet; and a magnet control means for preventing the movement of the power generation magnet at a set swing speed or lower.

5 Claims, 11 Drawing Sheets

(58) Field of Classification Search
CPC ..... A63B 2209/00; A63B 71/0619; A63B 2102/32; A63B 2071/0655; A63B 2071/0625; A63B 2102/18; A63B 2225/09; A63B 2024/0043; A63B 53/10; A63B 69/36
USPC ..... 473/223
See application file for complete search history.

(56) References Cited

U.S. PATENT DOCUMENTS

| | | | | |
|---|---|---|---|---|
| 7,727,090 | B2 * | 6/2010 | Gant | A63B 59/50 473/453 |
| 8,998,739 | B2 * | 4/2015 | Haight | A63B 24/0003 473/220 |
| 2008/0305895 | A1 | 12/2008 | Gant | |

FOREIGN PATENT DOCUMENTS

| | | | |
|---|---|---|---|
| KR | 10-1048211 | B1 | 7/2011 |
| KR | 10-2013-0070709 | A | 6/2013 |
| KR | 10-1513473 | B1 | 4/2015 |
| KR | 10-2016-0011085 | A | 1/2016 |
| KR | 10-1762793 | B1 | 7/2017 |

* cited by examiner

SWING PRACTICE DEVICE FOR EMITTING LIGHT AT IMPACT THROUGH SELF-GENERATION

This application is a national stage application of PCT/KR2019/007493 filed on Jun. 21, 2019, which claims priorities of Korean patent application number 10-2018-0088271 filed on Jul. 30, 2018. The disclosure of each of the foregoing applications is incorporated herein by reference in its entirety.

TECHNICAL FIELD

The present invention relates to a swing practice device and, more specifically, to a swing practice device for emitting light at impact through self-generation, the device enabling an impact moment to be checked with the naked eyes without needing a battery by emitting light at an impact time point through self-generation during swinging by using a golf club, a baseball bat, and the like.

BACKGROUND

In general, swing exercise devices are widely applied to golf clubs. In the case of golf, depending on the correct posture and the correct point of impact, the golf ball can be sent to the desired place and the desired distance.

There are two types of conventional golf exercise device: checking the impact moment through the impact sound generated in the head and checking it through the light emitted from the head.

The golf club to be checked through the impact sound has been filed by the same applicant and registered as Korean Patent Registration No. 10-1048211, On reviewing its structure, it includes a first body coupled to the end of the shaft; a second body formed of a tube having both ends penetrated, the second body being screwed to the rear of the first body; a moving weight that is movably installed inside the second body; a magnet for fixing the moving weight to the fore end of the second body by magnetic force; an adjusting means for adjusting the strength of the magnetic force by adjusting the distance between the magnet and the moving weight; a cap screwed to the rear end of the second body; and a return means installed between the cap and the moving weight so as to return the moved moving weight by centrifugal force.

The golf exercise device formed of such a structure controls the strength of magnetic force using the adjusting means, and the impact sound is generated at an impact position only when the swing speed required for the target flying distance is achieved during the swing. Therefore, the practicer can practice the sense of impact for each target flying distance by himself or herself. However; it is not easy to accurately recognize the moment because the swing speed is recognized through the impact sound.

In addition; the Korean Patent Laid-Open Publication No. 10-2003-0010966 relates to an apparatus for analyzing golf swings using a light-emitting diode. On reviewing its structure, the apparatus includes an automatic switch unit which is conductively connected with the pressure of a centrifugal weight moving downward by a centrifugal force generated during a swing operation, having a (+) electrode plate and a (−) electrode plate which are elastic members in the shape of a leaf spring having a restoring force, one end of each plate having an insulator inserted therethrough, the plates being fixed to a cover to be described below with a certain clearance; 2 to 4 power supply batteries; a cover portion including a light emitting diode protruding from the upper periphery of the cover portion and fixed toward the user's eye; a fixing device including a magnet control means capable of being coupled to an upper portion of the head of the golf club; wherein the cover portion and the fixing device portion are combined with each other.

The golf swing analysis device with this structure is manufactured in a small size; so that it is light and inexpensive. And it is freely attached and detached by the magnet control means of the fixing device so as to be easily applied to the existing golf club and used. Further, since an LED is automatically turned on by centrifugal force only when swinging over a certain speed, so the device is convenient to use and consumes little power. However, there is a hassle of having to replace the battery regularly, and there is a disadvantage that the force cannot be adjusted according to the flying distance.

In addition, Korean Patent Laid-Open Publication No. 10-2016-0011085 relates to a light-emitting golf swing exerciser. Reviewing its structure, the practice includes a connector fixedly installed at the bottom of the shaft of various golf clubs, posture correction or swing exercise equipment; a cylindrical inner casing screwed to a lower portion of the connector; a lower casing configured to be screwed to a lower portion of the inner casing to insert a fixing bracket having a switch installed therein, and to receive a battery electrically connected to the switch to the lower side; a cover casing configured to be screwed to a lower portion of the lower casing to cover the battery and to replace the battery when separated from the lower casing; an outer casing installed so as to contact the outer upper portion of the lower casing after coupling the lower casing to the inner casing after coupling the lower casing to the inner casing to the outside before coupling the lower casing to the inner casing; a transparent or semi-transparent light emitting casing fitted to the outside of the inner casing between the upper portion of the outer casing and the connector, having several LED lamps which are fixedly installed therein, the LED lamp being electrically connected to the switch of the lower casing by the connection wires penetrating into the outer casing; and an operation tool in which a pressing piece for pressing a switch of the fixing bracket is protruded through a pressing hole formed through the pressing hole in the upper center of the lower casing at the lower end of the cylindrical inner casing to be transferred back and forth in a longitudinal direction from the inside of the cylindrical inner casing. The light-emitting golf swing exerciser having such a structure moves the operation tool at the impact moment and presses the switch to emit light from the LED lamp so that the swing trajectory can be checked. However, there is a hassle of having to replace the battery regularly, and there is a disadvantage that the force cannot be adjusted according to the flying distance.

PRIOR ART DOCUMENTS

Patent Documents (Patent Document 0001) Korean Registered Patent Publication No. 10-1048211 (2011 Jul. 4)

(Patent Document 0002) Korean Patent Laid-Open Publication No. 10-2003-0010966 (2003 Feb. 6)

(Patent Document 0003) Korean Patent Laid-Open Publication No. 10-2016-0011085 (2016 Jan. 29)

DISCLOSURE

Technical Problem

The present invention was suggested to solve the problems as in the prior art, and one object of the invention is to provide a swing exerciser that self-powers and emits light at impact, self-powered by a moving weight that moves by centrifugal force when swinging to emit a lamp, thereby providing a swing exerciser that self-powers and emits light at impact, which does not require a battery.

Another object of the present invention is to provide a swing exerciser capable of adjusting the force according to the flying distance by adjusting the strength of the magnetic force that fixes the moving weight, while self-generating and emitting light at impact.

SUMMARY

In order to accomplish the object, the swing practice device for emitting light at impact through self-generation includes:

a power generation magnet provided on a shaft 1 and sliding in the longitudinal direction of the shaft when swinging;

a power generation coil provided around the moving section of the power generation magnet;

a light-emitting lamp connected to the power generation coil and turned on by the movement of the power generation magnet; and a magnet control means configured to prevent the movement of the power generation magnet at a preset swing speed or below.

Further, the magnet control means includes:

a magnet fixing unit provided at the end of the shaft;

a fixed magnet provided at the fore end of the magnet fixing unit;

a head body that is helically coupled to the magnet fixing unit and has a space communicating with the fixed magnet therein;

a metal moving weight that is built into the head body and slides in the longitudinal direction by centrifugal force when swinging;

a first coil spring that restores the moving weight to the original state when the centrifugal force is released; and a stepped edge that is formed in a protruding manner and integrally with the inner periphery of the head body to support one end of the moving weight, thereby adjusting the distance between the moving weight and the fixed magnet according to the rotation direction of the head body.

The power generation magnet is installed on the moving weight and the power generation coil is fixed to the head body.

Further; the head body includes:

a space adjustment tube that is helically coupled to the magnet fixing unit and moves in the longitudinal direction according to the rotation direction so that the moving weight is contacted closely to the stepped edge provided at the fore end to adjust the distance between the moving weight and the fixed magnet:

a cylinder coupled to the fore end of the space adjustment tube and formed of a cylinder forming a space in which the moving weight having the power generation magnet installed therein moves back and forth; the cylinder having the power generation coil wound around the outer periphery thereof; and a case configured to surround the space adjustment tube and the cylinder.

Further, the moving weight includes a cylindrical body having one end open and a space therein and a cover coupled to the opened end of the body, whereby the power generation magnet is built into the inner space of the body of the moving weight.

Further, the power generation magnet is spaced apart from the fore end of the moving weight; the head body forms a partition wall to divide the space in which the power generation magnet moves and the space in which the moving weight moves, and a connecting rod that connects the moving weight to the power generation magnet is installed through the partition wall.

Further; the magnet control means includes:

a magnet fixing unit provided at the end of the shaft;

a fixed magnet provided at the fore end of the magnet fixing unit;

a head body that is helically coupled to the magnet fixing unit and has a space communicating with the fixed magnet therein;

a metal moving weight that is built into the head body and slides in the longitudinal direction by centrifugal force when swinging;

a first coil spring that restores the moving weight to the original state when the centrifugal force is released; and a stepped edge that is formed in a protruding manner and integrally with the inner periphery of the head body to adjust the distance between the moving weight and the fixed magnet according to the rotation direction of the head body.

The power generation magnet is provided at the fore end of the moving weight to slide by the impact of the moving weight and is restored to the original state by a second coil spring provided at the fore end, and the power generation coil is fixed to the head body.

Further, the head body includes:

a space adjustment tube that is helically coupled to the magnet fixing unit and moves in the longitudinal direction according to the rotation direction so that the moving weight is contacted closely to the stepped edge provided at the fore end to adjust the distance between the moving weight and the fixed magnet;

a cylinder coupled to the fore end of the space adjustment tube and formed of a cylinder having one end open to form a space in which the moving weight moves back and forth;

a coil fixing tube coupled to the fore end of the cylinder, formed of a cylinder having a space in which the power generation magnet moves back and forth, the coil fixing tube having the power generation coil wound around the outer periphery thereof; and a case configured to surround the space adjustment tube, the cylinder, and the coil fixing tube.

EFFECTS

The swing practice device for emitting light at impact through self-generation according to the present invention has an effect that the self-generation is accomplished while a power generation magnet moving by the centrifugal force passes through the power generation coil when swinging to turn on a light emitting lamp, whereby a swing exerciser can identify the impact position with a naked eye.

Further, another object of the present invention is that the practicer can practice the impact moment according to the swing speed by the magnet control means that adjusts the strength of the magnetic force, and the magnet control means is simple in its structure so that the manufacturing cost is low and the fabrication is performed with ease.

DETAILED DESCRIPTION

Hereinafter, a preferred embodiment of a swing exercise device that self-generates and emits light upon impact according to a first embodiment of the present invention will be described in detail with reference to the accompanying drawings.

Figure 1:
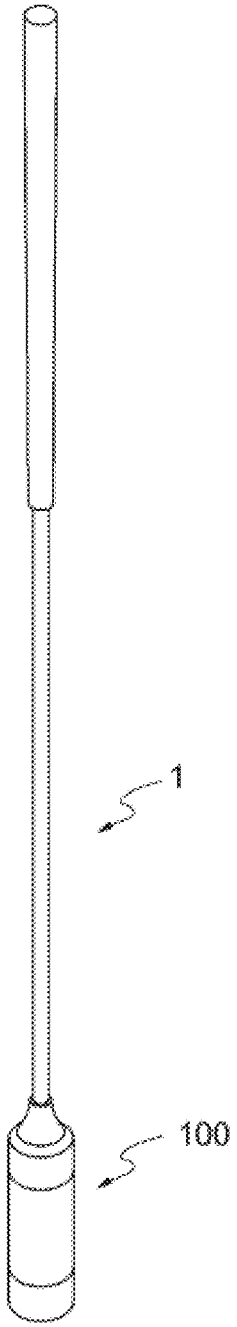
FIG. 1 is a schematic view showing the structure of a swing practice device according to a first embodiment of the present invention.
Figure 2:
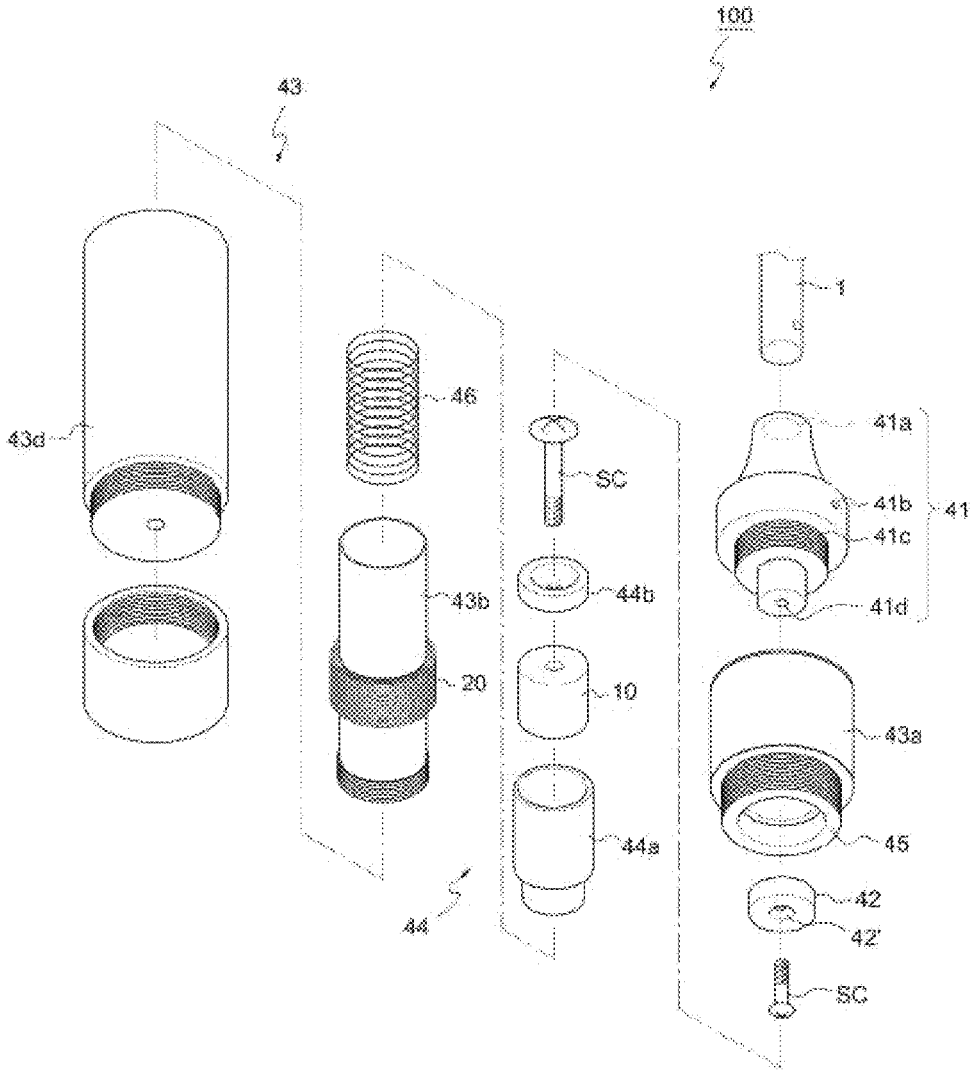
FIG. 2 is an exploded perspective view showing the structure of the swing practice device according to the first embodiment of the present invention.
Figure 3:
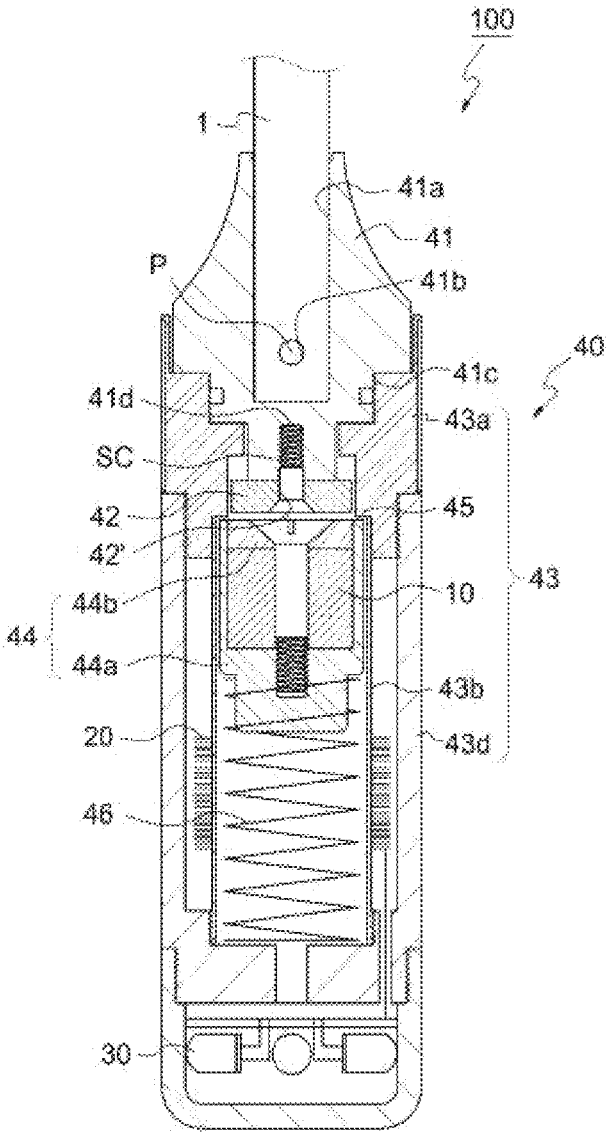
FIG. 3 is a cross-sectional view showing the structure of the swing practice device according to the first embodiment of the present invention.
Figure 4:
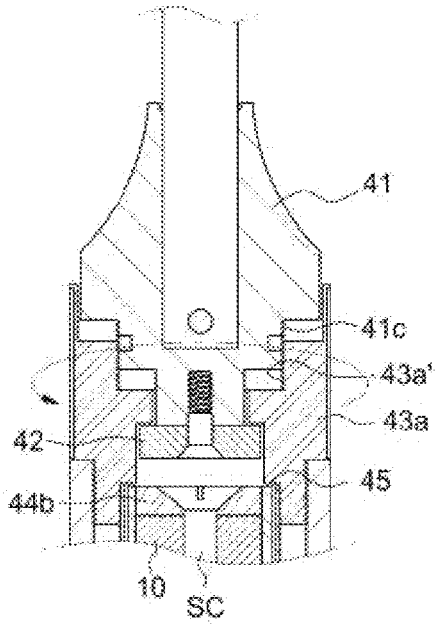
FIG. 4 is a cross-sectional diagram showing a state that the strength of a fixed magnet is adjusted by a magnet control means according to the first embodiment of the present invention.
Figure 5:
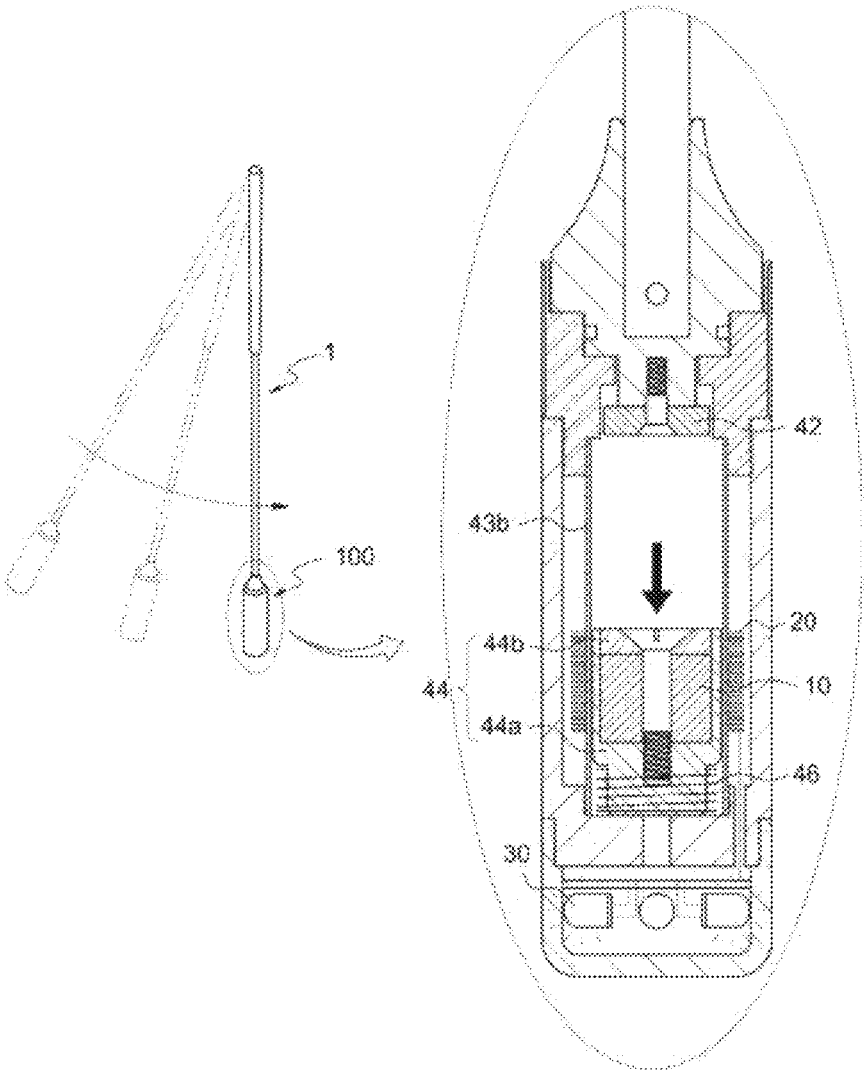
FIG. 5 is a use state view showing an operating state of the swing exercise device according to the first embodiment of the present invention.

FIG. 1 is a schematic view showing the structure of a swing exercise device according to a first embodiment of the present invention, FIG. 2 is an exploded perspective view showing the structure of the swing exercise device, FIG. 3 is a cross-sectional view showing the structure of the swing exercise device, FIG. 4 is a cross-sectional view showing a state in which the magnetic strength of a fixed magnet is adjusted by a magnet control means of the present invention, and FIG. 5 is a use state view showing the operating state of the swing exercise device.

As shown in these figures, the swing practice device 100 for emitting light at impact through self-generation includes a power generation magnet 10 provided on a shaft 1 and sliding in the longitudinal direction of the shaft 1 when swinging; a power generation coil 20 provided around the moving section of the power generation magnet 10; a light-emitting lamp 30 connected to the power generation coil 20 and turned on by the movement of the power generation magnet 10; and a magnet control means 40 configured to prevent the movement of the power generation magnet 10 at a preset swing speed or below, wherein the magnet control means 40 includes a magnet fixing unit 41 provided at the end of the shaft 1; a fixed magnet 42 provided at the fore end of the magnet fixing unit 41; a head body 43 that is helically coupled to the magnet fixing unit 41 and has a space communicating with the fixed magnet 42 therein; a metal moving weight 44 that is built into the head body 43 and slides in the longitudinal direction by centrifugal force when swinging; a first coil spring 46 that restores the moving weight 44 to the original state when the centrifugal force is released; and a stepped edge 45 that is formed in a protruding manner and integrally with the inner periphery of the head body 43 to support one end of the moving weight 44, and the power generation magnet 10 is installed on the moving weight 44 and the power generation coil 20 is fixed to the head body 43.

The magnet fixing unit 41 is fixed to the end of the shaft 1, and an insertion hole 41*a* is formed at one end so that the shaft 1 is inserted thereinto, and the shaft 1 and the magnet holder 41 have a pin hole 41*b* formed in the lateral direction and a fixing pin P is inserted into the fixing hole. Therefore, the shaft 1 and the magnet fixing unit 41 are integrated. Here, instead of the fixing pin P, screws or bolts may be used. The magnet fixing unit 41 has a male thread 41*c* formed on the outer periphery and is helically coupled to the head body 43.

The fixed magnet 42 is attached to the fore end of the magnet fixing unit 41, wherein a through hole 42' is formed in the center, and a screw hole 41*d* is formed at the fore end of the magnet fixing unit 41 so that they are fastened each other by a screw SC, Here, the fixed magnet 42 forms a plate-shaped placeholder on one side so that the plate head screw is not exposed to the outside of the fixed magnet 42, so that when the moving weight 44 and the fixed magnet 42 are close, the screw SC does not cause interference. The head body 43 is installed on the magnet fixing unit 41, which is composed of a space adjustment tube 43*a*, a cylinder 43*b*, and a case 43*d*.

The space adjustment tube 43*a* is made of a cylinder penetrating in the longitudinal direction, and a female thread 43*a'* is formed at one end of the inner circumference to be helically fastened with the male thread 41*c* of the magnet fixing unit 41. At the fore end of the space adjustment tube 43*a*, a cylindrical stepped edge 45 supporting the rear surface of the moving weight 44 is formed, and the fixed magnet 42 can be inserted into the stepped edge 45.

With this structure, the stepped edge 45 at the fore end is transferred from the magnet fixing unit 41 according to the rotation direction of the space control tube 43*a* and pushes the moving weight 44, so that the distance between the moving weight 44 and the fixed magnet 42 is adjusted. Here, if the distance between the fixed magnet 42 and the moving weight 44 is narrow, the attractive force for pulling the moving weight 44 acts large, and if the distance is wide, the attractive force for pulling the moving weight 44 acts small.

The cylinder 43*b* is installed at the fore end of the space adjustment tube 43*a*, and consists of a cylinder with both ends open, so a space in which the moving weight 44 moves back and forth is formed. The cylinder 43*b* is made of a non-ferrous metal such as stainless steel or resin and has a thin thickness so as not to be affected by magnetic force. The power generation coil 20 is wound around the outer periphery of the cylinder 43*b*, so that electricity is generated whenever the moving weight 44 containing the power generation magnet 10 travel s the inside of the power generation coil 20.

The moving weight 44 is composed of a cylindrical body 44*a* having an open end and a space therein, and a cover 44*b* coupled to the open end of the body 44*a*, and the power generation magnet 10 is built into the body 44*a* of the moving weight 44. Here, the moving weight 44 is formed thinly, but is formed of metal to prevent the power generation magnet 10 bunt into the inside from being destroyed by the impact upon impact due to hitting. The moving weight 44 maintains a close state by the attractive force of the fixed magnet 42, and then moves to the fore end by centrifugal force when the shaft 1 swings, thereby generating an impact sound while colliding with the inner wall of the end of the cylinder 43*b*. At this time, since the moving weight 44 moves only when a swing is greater than the attractive force of the fixed magnet 42, impact practice can be performed at a desired swing point, that is, a hitting point.

A first coil spring 46 is installed between the ends of the moving weight 44 and the cylinder 43*b*, so that when the centrifugal force is removed, the moving weight 44 is restored to the original state, that is, to the position where a fixed magnet 42 is placed.

The case 43*d* is made of a cylindrical shape surrounding the space adjustment tube 43*a* and the cylinder 43*b*, and is fixedly installed on the space adjustment tube 43*a*. When it grips and rotates the case 43*d*, the space adjustment tube 43*a* integrated therewith rotates together. In addition, a light emitting lamp 30 is installed inside the case 43*d* to be connected to the power generation coil 20. The case 43*d* is made transparent or semi-transparent so that light can be exposed when the light-emitting lamp 30 is turned on. When the moving weight 44 is moved by centrifugal force, the power generation magnet 10 moves together to pass through the power generation coil 20, thereby lighting the light emitting lamp 30. Here, as shown in the drawing, the case 43*d* may have a light-emitting cap separately installed at its end, and a light-emitting lamp 30 is built in the light-emitting cap so that light is emitted from the light-emitting cap.

Finally, a numerical value and a scale according to the flying distance are displayed at the boundary between the head body 43 and the shaft 1.

The operation and effect of the swing exercise device 100 for emitting light at impact through self-generation according to the present invention having such a structure will be described in detail.

First, the moving weight 44 is located on the side of the fixed magnet 10 by the first coil spring 46, and keeps in close contact with a stepped edge 45 of the distance adjustment tube 43*a* of the head body 43 by the attraction of the fixed magnet 10.

In this state, the user rotates the head body 43 according to a desired flying distance to adjust the distance between the fixed magnet 42 and the moving weight 44. That is, in accordance with the rotation direction of the head body 43, the stepped edge 45 pushes the moving weight 44 to adjust the distance between the fixed magnet 42 and the moving weight 44.

When the flying distance setting is completed by adjusting the distance between the fixed magnet 42 and the moving weight 44, the user takes a posture and swings.

At this time, at the moment of impact, that is, at the moment when a centrifugal force greater than the attractive force of the fixed magnet 42 and the moving weight 44 is generated, the moving weight 44 slides by the centrifugal force and strikes the end of the cylinder 43*b* and an impact sound is generated. At the same time, the power generation magnet 10 built in the moving weight 44 also moves and passes through the inner portion of the power generation coil 20. At this time, an induced current flows through the power generation coil 20 due to the electromagnetic induction phenomenon, and the light emitting lamp 30 connected to the power generation coil 20 is momentarily turned on and off.

As a result, by recognizing the impact sound of the moving weight 44 through a sense of hearing at the moment of impact, and recognizing the lighting of the light-emitting lamp 30 through a sense of sight to confirm the position at the time of impact, it is possible to correct the correct impact point. In addition, when the moving weight 44 collides, the impact is transmitted to the hand, so that it feels as if the practicer is actually hitting the ball.

Figure 6:
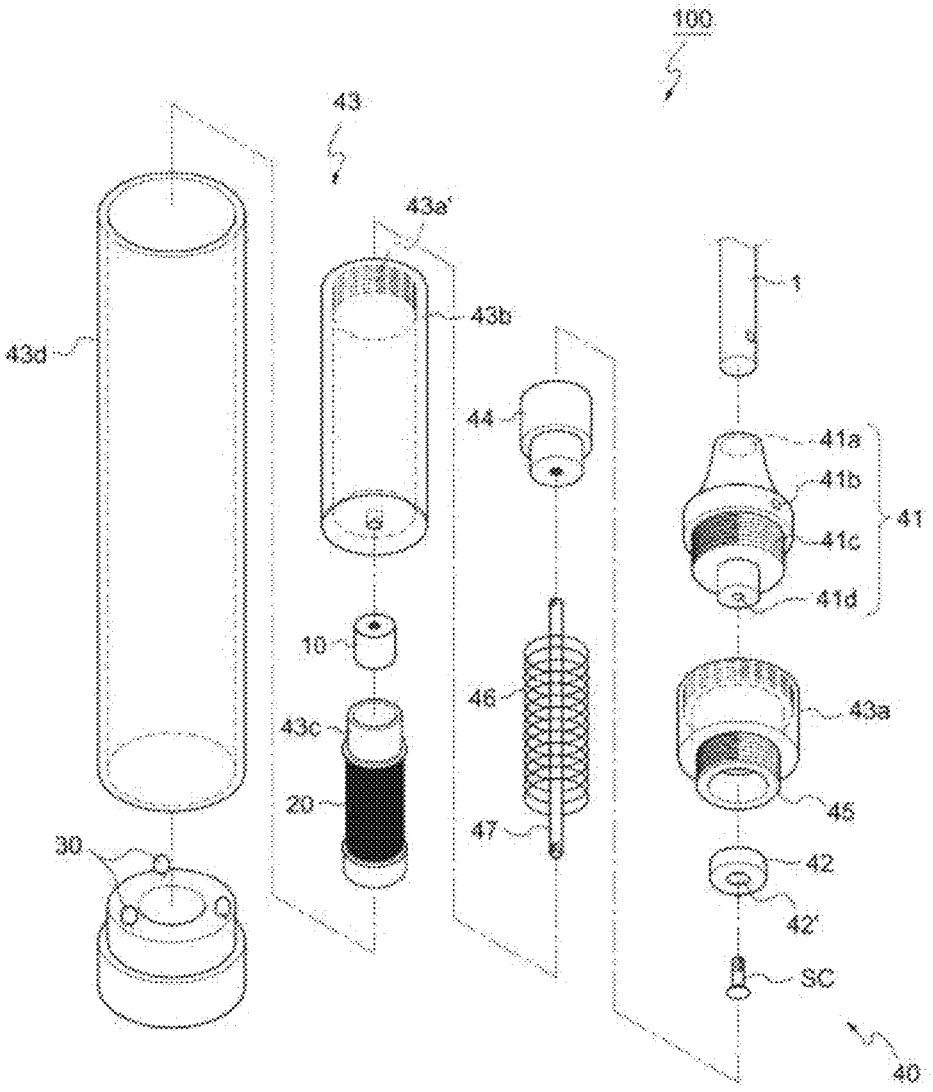
FIG. 6 is an exploded perspective view showing the structure of a swing exercise device according to a second embodiment of the present invention.
Figure 7:
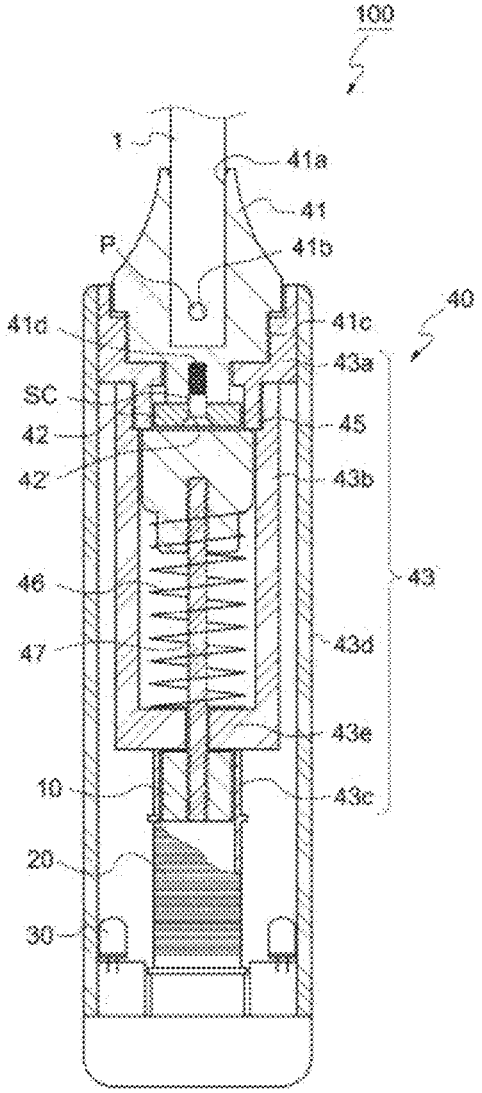
FIG. 7 is a cross-sectional view showing the structure of the swing exercise device according to the second embodiment of the present invention.
Figure 8:
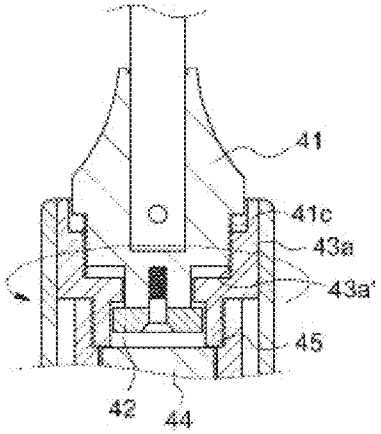
FIG. 8 is a cross-sectional view showing a state in which the magnetic strength of the fixed magnet is adjusted by the magnet control means according to the second embodiment of the present invention.
Figure 9:
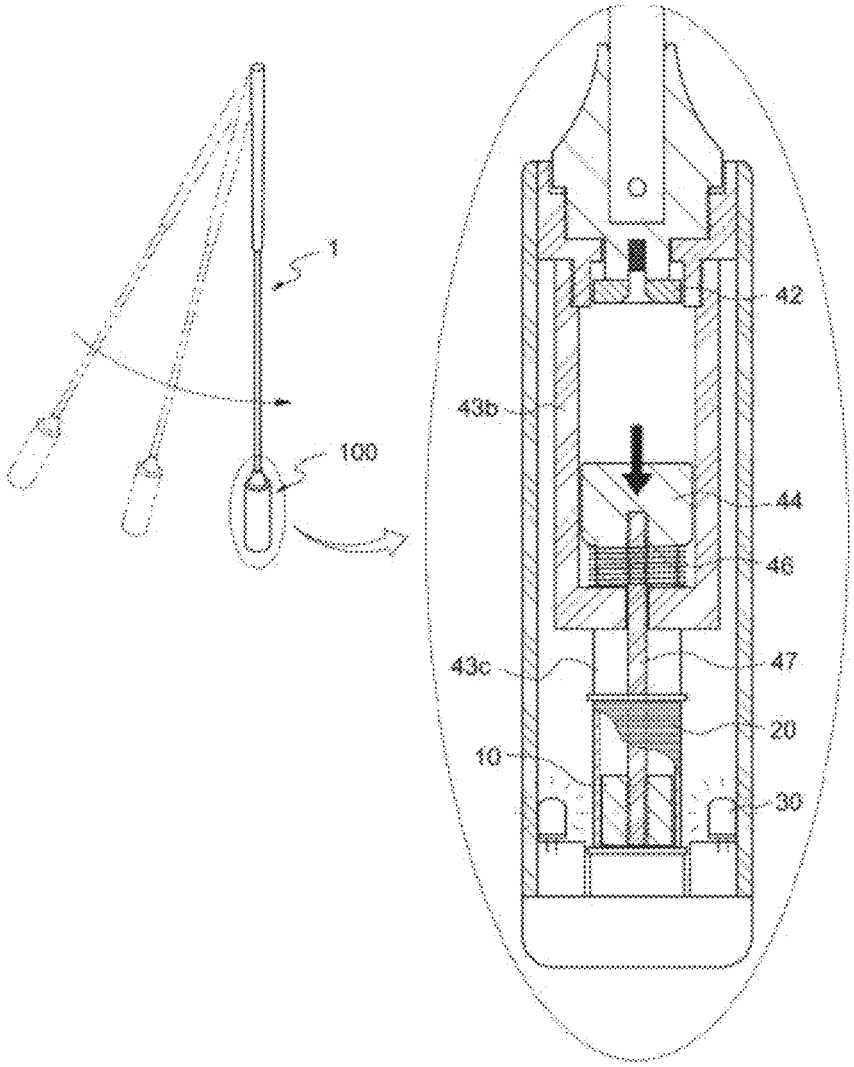
FIG. 9 is a use state view showing an operating state of the swing exercise device according to the second embodiment of the present invention.

FIG. 6 is an exploded perspective view showing the structure of a swing exercise device according to a second embodiment of the present invention, FIG. 7 is a cross-sectional view showing the structure of the swing exercise device, FIG. 8 is a cross-sectional view showing a state in which the magnetic strength of the fixed magnet is adjusted by the magnet control means, and FIG. 9 is a use state view showing an operating state of the swing exercise device.

As shown in these drawings, a swing practice device for emitting light at impact through self-generation according to a second embodiment of the present invention, includes: a power generation magnet 10 provided on a shaft 1 and sliding in the longitudinal direction of the shaft 1 when swinging; a power generation coil 20 provided around the moving section of the power generation magnet 10; a light-emitting lamp 30 connected to the power generation coil 20 and turned on by the movement of the power generation magnet 10; and a magnet control means 40 configured to prevent the movement of the power generation magnet 10 at a preset swing speed or below, wherein the magnet control means 40 includes: a magnet fixing unit 41 provided at the end of the shaft 1; a fixed magnet 42 provided at the fore end of the magnet fixing unit 41; a head body 43 that is helically coupled to the magnet fixing unit 41 and has a space communicating with the fixed magnet 42 therein; a metal moving weight 44 that is built into the head body 43 and slides in the longitudinal direction by centrifugal force when swinging; and a stepped edge 45 that is formed in a protruding manner and integrally with the inner periphery of the head body 43 to adjust the distance between the moving weight 44 and the fixed magnet 42 according to the rotation direction of the head body 43.

The magnet fixing unit 41 is fixed to the end of the shaft 1, and an insertion hole 41*a* is formed at one end to insert the shaft 1, The shaft 1 and the magnet fixing unit 41 have pin hole 41*b* formed in the lateral direction and integrated together when a fixing pin P inserts the pin hole. Here, instead of the fixing pin P, screws or bolts may be used. The magnet fixing unit 41 has a male thread 41*c* formed on the outer periphery and is helically coupled to the head body 43.

The fixed magnet 42 is attached to the fore end of the magnet fixing unit 41, wherein a through hole 42' is formed in the center, and a screw hole 41*d* is formed at the fore end of the magnet fixing unit 41 so that they are fastened each other by a screw SC. Here, the fixed magnet 42 forms a plate-shaped placeholder on one side so that the plate head screw is not exposed to the outside of the fixed magnet 42, so that when the interference is not occurred between the moving weight 44 and the fixed magnet 42.

The head body 43 is installed on the magnet fixing unit 41, which is composed of a space adjustment tube 43*a*, a cylinder 43*b*, a coil fixing tube 43*c* and a case 43*d*.

The space adjustment tube 43*a* is made of a cylinder penetrating in the longitudinal direction, and a female thread 43*a* is formed at one end of the inner circumference to be helically fastened with the male thread 41*c* of the magnet fixing unit 41. At the fore end of the space adjustment tube 43*a*, a cylindrical stepped edge 45 supporting the rear surface of the moving weight 44 is formed, and the fixed magnet 42 can be inserted into the stepped edge 45.

With this structure, the stepped edge 45 at the fore end is transferred from the magnet fixing unit 41 according to the rotation direction of the space control tube 43*a* and pushes the moving weight 44, so that the distance between the moving weight 44 and the fixed magnet 42 is adjusted. Here, if the distance between the fixed magnet 42 and the moving weight 44 is narrow, the attractive force for pulling the moving weight 44 acts large, and if the distance is wide, the attractive force for pulling the moving weight 44 acts small.

The cylinder 43*b* is installed at the fore end of the space adjustment tube 43*a*, and consists of a cylinder with one end open, so a space in which the moving weight 44 moves back and forth is formed.

The moving weight 44 is formed in a cylindrical shape and installed in the cylinder 43*b* so as to slide back and forth in the longitudinal direction of the cylinder 43*b*. The moving weight 44 is formed of metal so that it maintains a close state by the attractive force of the fixed magnet 42, and then moves to the fore end by centrifugal force when the shaft 1 swings, thereby generating an impact sound while colliding with the inner wall of the end of the cylinder 43*b*. At this time, since the moving weight 44 moves only when a swing is greater than the attractive force of the fixed magnet 42, impact practice can be performed at a desired swing point, that is, a hitting point.

A first coil spring 46 is installed between the ends of the moving weight 44 and the cylinder 43*b*, so that when the centrifugal force is removed, the moving weight 44 is restored to the original state, that is, to the position where a fixed magnet 42 is placed.

The coil fixing tube 43*c* is fixedly installed at the fore end of the cylinder 43*b*, and is made of a cylinder to form a space therein. The power generation magnet 42 is built in this space to move back and forth. The coil fixing tube 43*c* has the power generation coil 20 wound around it to generate power whenever the power generation magnet 10 moves in the power generation coil 20.

The case 43*d* is made of a cylindrical shape surrounding the space control pipe 43*a*, the cylinder 43*b* and the coil fixing pipe 43*c*, and is fixedly installed on the space control pipe 43*a* to grip and rotate the case 43*d*. AT this time, the space adjustment tube 43*a* integrated with this rotates together. In addition, a light emitting lamp 30 is installed inside the case 43*d* to be connected to the power generation coil 20. The case 43*d* is made in transparent or semi-transparent manner so that light can be exposed when the light emitting lamp 30 is turned on.

On the other hand, the moving weight 44 and the power generating magnet 10 are connected to each other by an elongated rod-shaped connecting rod 47 to be integrated together. The connecting rod 47 passes through the cylinder 43*b* and connects the generating magnet 10 to the moving weight 44.

Therefore, when the moving weight 44 moves by centrifugal force, the power generation magnet 10 moves together and passes through the power generation coil 20 so that the light emitting lamp 30 is turned on.

The cylinder 43*b* of the head body 43 and the coil fixing tube 43*c* are integrally formed, and a partition wall 43*e* is formed therebetween to divide a space in which the power generation magnet 10 moves and a space in which the moving weight 44 moves to each other. In this case, the connecting rod 47 connecting the moving weight 44 and the power generating magnet 10 to each other is installed through the partition wall 43*e*.

Finally, numerical values and scales according to the flying distance are displayed at the boundary between the head body 43 and the shaft 1.

The operation and effect of the swing exercise device 100 for emitting light at impact through self-generation according to the second embodiment of the present invention having such a structure will be described in detail.

First, the moving weight 44 is located on the side of the fixed magnet 10 by the first coil spring 46, and keeps in close contact with a stepped edge 45 of the distance adjustment tube 43*a* of the head body 43 by the attraction of the fixed magnet 10.

In this state, the user rotates the head body 43 according to a desired flying distance to adjust the distance between the fixed magnet 42 and the moving weight 44. That is, in accordance with the rotation direction of the head body 43, the stepped edge 45 pushes the moving weight 44 to adjust the distance between the fixed magnet 42 and the moving weight 44.

When the flying distance setting is completed by adjusting the distance between the fixed magnet 42 and the moving weight 44, the user takes a posture and swings.

At this time, at the moment of impact, that is, at the moment when a centrifugal force greater than the attractive force of the fixed magnet 42 and the moving weight 44 is generated, the moving weight 44 slides by the centrifugal force and strikes the end of the cylinder 43*b* and an impact sound is generated. At the same time, the power generation magnet 10 also moves by the connecting rod 47 connected to the moving weight 44 and passes through the inner portion of the power generation coil 20. At this time, an induced current flows through the power generation coil 20 due to the electromagnetic induction phenomenon, and the light emitting lamp 30 connected to the power generation coil 20 is momentarily turned on and off.

As a result, by recognizing the impact sound of the moving weight 44 through a sense of hearing at the moment of impact, and recognizing the lighting of the light-emitting lamp 30 through a sense of sight to confirm the position at the time of impact, it is possible to correct the correct impact point. In addition, when the moving weight 44 collides, the impact is transmitted to the hand, so that it feels as if the practicer is actually hitting the ball.

Figure 10:
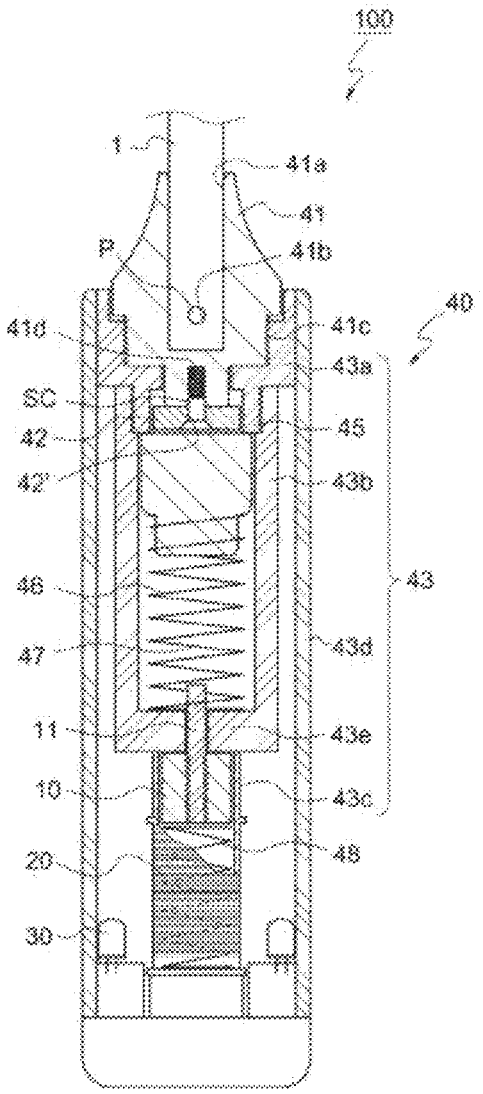
FIG. 10 is a cross-sectional view showing the structure of a swing exercise device according to a third embodiment of the present invention.
Figure 11:
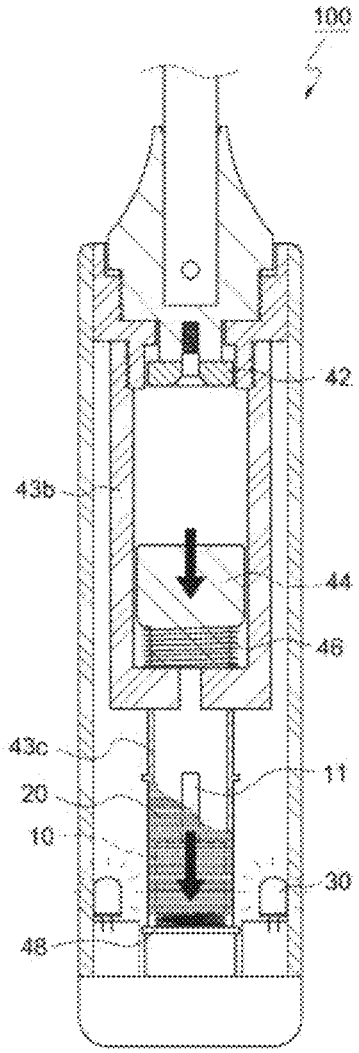
FIG. 11 is a use state view showing an operating state of the swing exercise device according to the third embodiment of the present invention.

FIG. 10 is a cross-sectional view showing the structure of a swing exercise device according to a third embodiment of the present invention and FIG. 11 is a use state view showing an operating state of the swing exercise device according to the third embodiment of the present invention.

As shown in these figures, in the swing practice device 100 for emitting light at impact through self-generation according to the third embodiment of the present invention, the power generation magnet 10 moves just before the moving weight 44 hits the cylinder 43*b*.

That is, the magnet control means 40 includes a magnet fixing unit 41 provided at the end of the shaft 1; a fixed magnet 42 provided at the fore end of the magnet fixing unit 41; a head body 43 that is helically coupled to the magnet fixing unit 41 and has a space communicating with the fixed magnet 42 therein; a metal moving weight 44 that is built into the head body 43 and slides in the longitudinal direction by centrifugal force when swinging; a first coil spring 46 that restores the moving weight 44 to the original state when the centrifugal force is released; and a stepped edge 45 that is formed in a protruding manner and integrally with the inner periphery of the head body 43 to adjust the distance between the moving weight 44 and the fixed magnet 42 according to the rotation direction of the head body 43.

The power generation magnet 10 is provided on the opposite side of the end of the cylinder 43*b* where the moving weight 44 slides and collides, and has the striking rod 11 protruding through the cylinder 43*b*, which is formed integrally therewith. Therefore, when the moving weight 44 slides, it hits the impact rod 11, so that the power generating magnet 10 moves. In addition, a second coil spring 48 is provided at the fore end of the power generation magnet 10 so that the power generation magnet 10 is restored to its original state, and the power generation coil 20 is fixed to the head body 43.

With this structure, the head body 43 does not need a connecting rod, so it does not have to be formed unnecessarily long, it is easy to assemble, and smooth sliding of the moving weight 44 is achieved.

DESCRIPTION OF SYMBOLS

1: shaft 10: power generation magnet 11: striking rod
20: power generation coil 30: light emitting lamp 40: magnet control means
41: magnet fixing unit 41*a*: insert hole 41*b*: pin hole
41*c*: male thread 41*d*: screw hole 42: fixed magnet
42': through hole 43: head body 43*a*: space adjustment tube
43*a*': female thread 43*b*: cylinder 43*c*: coil fixing tube
43*d*: case 43*e*: partition wall 44: moving weight
44*a*: body 44*b*: cover 45: stepped edge
46: first coil spring 47: connecting rod 48: second coil spring
P: fixing pin SC: screw 100: swing practice device

INDUSTRIAL APPLICABILITY

The present invention relates to a swing practice device, and more specifically, to a swing practice device for emitting light at impact through self-generation, capable of achieving a self-generation to have a lamp turned on while a power generation magnet moving by centrifugal force when swing passes through a power generation coil, whereby the device does not need a battery. Further, a user can directly see that light is emitted at impact so that user's impact accuracy is enhanced when the technology of the present; invention is applied to golf clubs or baseball bats.

The invention claimed is:

1. A swing practice device for emitting light at impact through self-generation, comprising:

a power generation magnet provided on a shaft and sliding in the longitudinal direction of the shaft when swinging;

a power generation coil provided around the moving section of the power generation magnet;

a light-emitting lamp connected to the power generation coil and turned on by the movement of the power generation magnet; and a magnet control means configured to prevent the movement of the power generation magnet at a preset swing speed or below, wherein the magnet control means comprises:

a magnet fixing unit provided at the end of the shaft;

a fixed magnet provided at the fore end of the magnet fixing unit;

a head body that is helically coupled to the magnet fixing unit and has a space communicating with the fixed magnet therein;

a metal moving weight that is built into the head body and slides in the longitudinal direction by centrifugal force when swinging;

a first coil spring that restores the moving weight to the original state when the centrifugal force is released; and a stepped edge that is formed in a protruding manner and integrally with the inner periphery of the head body to support one end of the moving weight, thereby adjusting the distance between the moving weight and the fixed magnet according to the rotation direction of the head body, wherein power generation magnet is installed on the moving weight, the power generation coil is fixed to the head body, the power generation magnet is spaced apart from the fore end of the moving weight, the head body forms a partition wall to divide the space in which the power generation magnet moves and the space in which the moving weight moves, and a connecting rod that connects the moving weight to the power generation magnet is installed through the partition wall.

2. A swing practice device for emitting light at impact through self-generation, comprising:

a power generation magnet provided on a shaft and sliding in the longitudinal direction of the shaft when swinging;

a power generation coil provided around the moving section of the power generation magnet;

a light-emitting lamp connected to the power generation coil and turned on by the movement of the power generation magnet; and a magnet control means configured to prevent the movement of the power generation magnet at a preset swing speed or below, wherein the magnet control means comprises:

a magnet fixing unit provided at the end of the shaft;

a fixed magnet provided at the fore end of the magnet fixing unit;

a head body that is helically coupled to the magnet fixing unit and has a space communicating with the fixed magnet therein;

a metal moving weight that is built into the head body and slides in the longitudinal direction by centrifugal force when swinging;

a first coil spring that restores the moving weight to the original state when the centrifugal force is released; and a stepped edge that is formed in a protruding manner and integrally with the inner periphery of the head body to support one end of the moving weight, thereby adjusting the distance between the moving weight and the fixed magnet according to the rotation direction of the head body, wherein power generation magnet is installed on the moving weight, the power generation coil is fixed to the head body, the moving weight includes a cylindrical body having one end open and a space therein and a cover coupled to the opened end of the body, whereby the power generation magnet is built into the inner space of the body of the moving weight.

3. The swing practice device according to claim 2, wherein the head body includes:

a space adjustment tube that is helically coupled to the magnet fixing unit and moves in the longitudinal direction according to the rotation direction so that the moving weight is contacted closely to the stepped edge provided at the fore end to adjust the distance between the moving weight and the fixed magnet;

a cylinder coupled to the fore end of the space adjustment tube and formed of a cylinder having one end open to form a space in which the moving weight moves back and forth;

a coil fixing tube coupled to the fore end of the cylinder, formed of a cylinder having a space in which the power generation magnet moves back and forth, the coil fixing tube having the power generation coil wound around the outer periphery thereof; and a case configured to surround the space adjustment tube, the cylinder, and the coil fixing tube.

4. A swing practice device for emitting light at impact through self-generation, comprising:

a power generation magnet provided on a shaft and sliding in the longitudinal direction of the shaft when swinging;

a power generation coil provided around the moving section of the power generation magnet;

a light-emitting lamp connected to the power generation coil and turned on by the movement of the power generation magnet; and a magnet control means to prevent the movement of the power generation magnet at a preset swing speed or below, wherein the magnet control means comprises:

a magnet fixing unit provided at the back end of the shaft;

a fixed magnet provided at the fore end of the magnet fixing unit;

a head body that is helically coupled to the magnet fixing unit and has a space communicating with the fixed magnet therein;

a metal moving weight that is built into the head body and slides in the longitudinal direction by centrifugal force during swinging;

a first coil spring that restores the moving weight to the original state when the centrifugal force is released; and a stepped edge that is formed in a protruding manner and integrally with the inner periphery of the head body to adjust the distance between the moving weight and the fixed magnet according to the rotation direction of the head body, wherein the power generation magnet is provided at the fore end of the moving weight to slide by the impact of the moving weight and is restored to the original state by a second coil spring provided at the fore end, and the power generation coil is fixed to the head body.

5. The swing practice device according to claim 4, wherein the head body includes:

a space adjustment tube that is helically coupled to the magnet fixing unit and moves in the longitudinal direction according to the rotation direction so that the moving weight is contacted closely to the stepped edge provided at the fore end to adjust the distance between the moving weight and the fixed magnet;

a cylinder coupled to the fore end of the space adjustment tube and formed of a cylinder having one end open to form a space in which the moving weight moves back and forth;

a coil fixing tube coupled to the fore end of the cylinder, formed of a cylinder having a space in which the power generation magnet moves back and forth, the coil fixing tube having the power generation coil wound around the outer periphery thereof; and a case configured to surround the space adjustment tube, the cylinder, and the coil fixing tube.

* * * * *